US005203100A

United States Patent [19]

Snyder et al.

[11] Patent Number: 5,203,100

[45] Date of Patent: Apr. 20, 1993

[54] OFFSET DITCHER WITH CHAIN DRIVE

[76] Inventors: Paul M. Snyder; John L. Snyder, both of 119 Ramsey Rd., Vincennes, Ind. 47591

[21] Appl. No.: 741,666

[22] Filed: Aug. 7, 1991

[51] Int. Cl.[5] ..... E02F 5/08

[52] U.S. Cl. ..... 37/92; 37/91; 37/189; 37/DIG. 17

[58] Field of Search ..... 37/91, 92, 94, 189, 37/DIG. 17; 172/125

[56] References Cited

U.S. PATENT DOCUMENTS

| | | | |
|---|---|---|---|
| 1,903,124 | 3/1933 | Miller et al. | 37/189 |
| 2,798,314 | 7/1957 | Brite | 37/92 |
| 3,066,745 | 12/1962 | Smith et al. | 37/189 |
| 4,459,767 | 7/1984 | Cartner | 37/DIG. 17 |
| 4,682,427 | 7/1987 | Dondi | 37/DIG. 17 |

FOREIGN PATENT DOCUMENTS

| | | | |
|---|---|---|---|
| 298344 | 11/1965 | Netherlands | 37/91 |
| 791006 | 2/1958 | United Kingdom | 37/91 |

*Primary Examiner*—David H. Corbin
*Assistant Examiner*—Arlen L. Olsen
*Attorney, Agent, or Firm*—H. John Barnett

[57] ABSTRACT

A folding boom side-ditcher which has a two-stage chain (or belt) drive from the power take-off (PTO) of a tractor. A laterally movable counterweight is provided so the folding boom has maximum side reach without danger of upset. Hydraulic actuating cylinders are provided for moving and positioning the boom and the counterweight, which are connected to the hydraulic system of the tractor in the conventional manner. The two-stage chain (or belt) drive for operating the digger head transfers more power through a two-stage reduction sprocket system, and the digging capacity at the digger head is increased substantially. This side-ditcher is more versatile because of the flexible boom, and it is considerably less expensive than the prior hydraulic drive systems of conventional side-ditchers.

4 Claims, 5 Drawing Sheets

OFFSET DITCHER WITH CHAIN DRIVE

FIELD OF THE INVENTION

This invention relates to earth moving equipment and, more particularly, to side ditchers for cutting ditches on various planes and levels and for maintaining ditches alongside roadways. The side ditcher of this invention is of the folding boom type operated from the power take-off (PTO) and hydraulic system of a farm tractor, and is typically mounted to a three point hitch of a tractor. A movable counterweight is provided opposite the folding boom to balance the implement when the boom is fully extended.

DESCRIPTION OF THE RELATED ART

The typical earth moving implement includes a digger head which is usually circular and multi-bladed, and which is mounted on the end of a boom for supporting and positioning the digger head. Some earth moving implements are designed to ride over the ditch or trench, so the boom is eliminated, and the digger attaches directly to the "PTO" of the tractor.

Bond U.S. Pat. No. 3,834,049 describes a single, endless chain trencher in which the chain is directly driven by the PTO of a tractor. Bond has no folding boom, nor any separate digger head. The digging tools are mounted directly on the drive chain. There is no gear reduction in Bond.

Bartels U.S. Pat. No. 3,933,053 shows a multi-purpose drive system for a large ditcher wheel, and is chain driven, but there is only a single, unjointed boom which trails the towing tractor. Bartels does not operate as a side-ditcher.

Brown U.S. Pat. No. 3,961,429 is directed to an excavating device of the same general type as shown in Bartels, but is self-propelled. Brown has a chain drive for the wheels of the implement, and a hydraulic drive for the excavating device. The excavating device is raised and lowered by means of a winch. There is no folding boom, so Brown's device is not a side ditcher.

Other patents of general interest include:

| Patent Number | Inventor | Date |
|---|---|---|
| 2,685,751 | Bain | 1954 |
| 2,969,601 | McMaster | 1961 |
| 3.683,522 | Rousseau et al | 1972 |
| 4,459,767 | Cartner | 1984 |
| 4,682,427 | Dondi | 1987 |
| 4,833,797 | Slunecka et al | 1989. |

Both Bain and Rousseau, et al are straight boom ditchers. Bain has a mechanical drive shaft from the PTO to the digger head. Rousseau, et al's ditcher has a telescoping boom and a hydraulic drive system. Cartner's and Dondi's devices are both of the folding boom type, but neither has a direct chain or belt drive for their digger heads. Cartner's digger head is hydraulically driven, and Dondi's head is driven through two drive shafts of the cardan type connected by a universal joint.

Slunecka, et al's device is mounted on the front of a tractor by a three-point hitch. This apparatus is supported by the wheels at the center of gravity of the trencher. This tool is not a side ditcher.

SUMMARY OF THE INVENTION

This invention is directed to a folding boom side-ditcher which has a two-stage chain (or belt) drive from the power take-off (PTO) of a tractor. A laterally movable counterweight is provided so the folding boom has maximum side reach without danger of upset. Hydraulic actuating cylinders are provided for moving and positioning the boom and the counterweight, which are connected to the hydraulic system of the tractor in the conventional manner.

The two-stage chain (or belt) drive for operating the digger head transfers more power through a two-stage reduction sprocket system, and the digging capacity at the digger head is increased substantially. This side-ditcher is more versatile because of the flexible boom, and it is considerably less expensive than the prior hydraulic drive systems of conventional side-ditchers. This side-ditcher can be either a left-hand drive, as shown in the drawings, or it also can be adapted to operate on the right-hand side of a tractor by adding a gear box at the PTO connection to change the direction of rotation of the digger head.

The laterally movable counterweight is automatically moved out to counterbalance the weight of the foldable boom as it is extended out to the side for ditching. There are a number of different, interchangeable working tools that may be conveniently used on the side=-ditcher in addition to the excavating head. Changing tools is simplified because of the chain (or belt) drive. No hydraulic lines need be changed, because the tool is not operated by the hydraulic system.

DESCRIPTION OF THE PREFERRED EMBODIMENT

Figure 1:
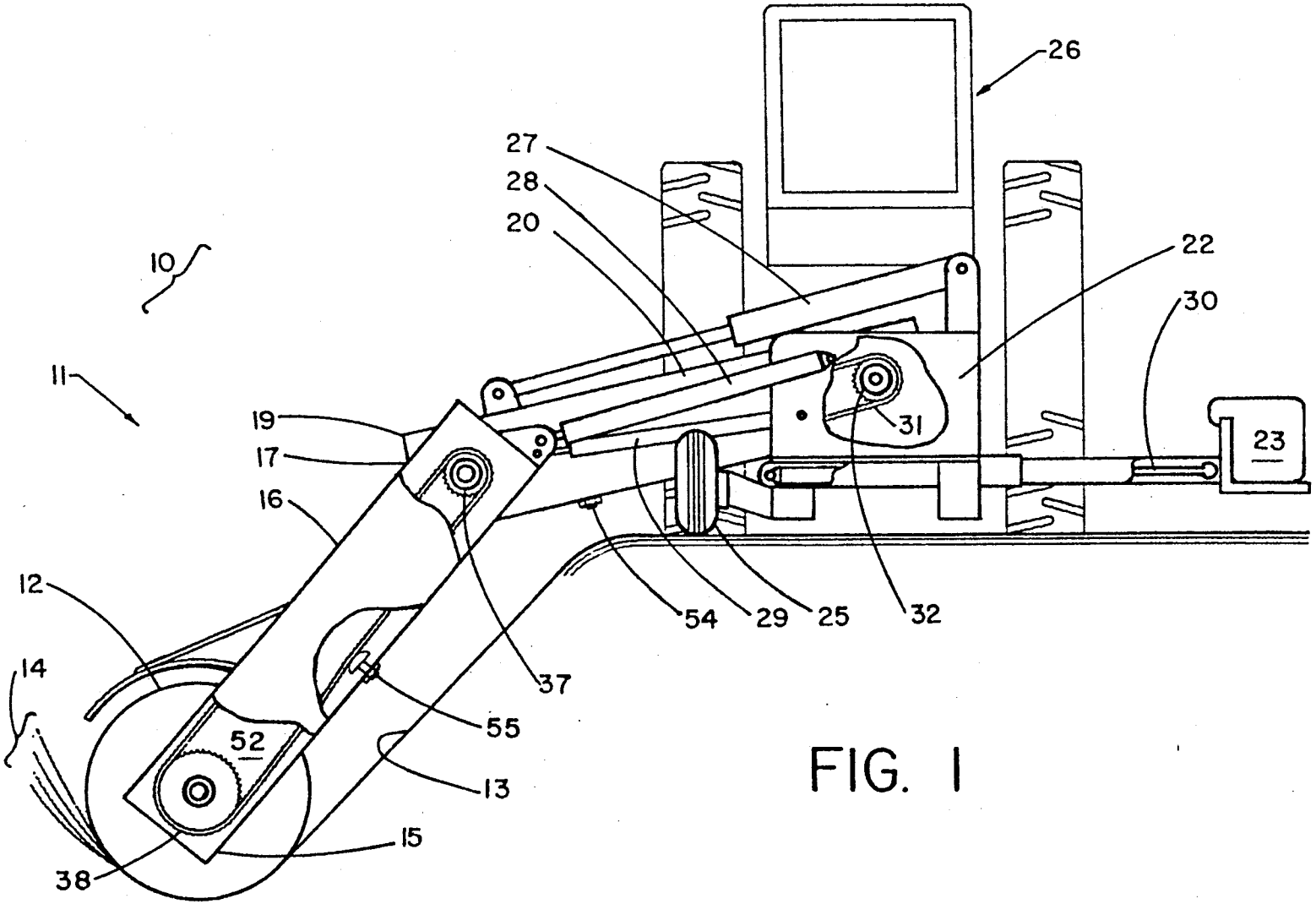
FIG. 1 of the drawings is rear view from the back of the ditcher and tractor, with parts broken away, showing the folding boom in the extended position for side-ditching with the counterweight fully extended.

As shown in the drawings, a folding boom side-ditcher 10 is shown in FIG. 1 with the folding boom 11 in the extended position and the digger head 12 disposed in a ditch 13 to remove dirt 14 away from the ditch as the digger head 12 is driven in a clockwise direction when viewed from the rear of the apparatus. Ditch 13 can be either newly created, or a new ditch profile can be created in an existing ditch.

The digger head 12 is mounted on outer end 15 of extension arm 16 of the folding boom 11. The extension arm 16 is pivotally connected to support frame 22 of the side-ditcher 10. A counterweight 23 extends out from counterweight transport tube 24 on the side opposite the folding boom to balance the side-ditcher 10 when the boom 11 is fully or partially extended.

The side-ditcher 10 is movably supported on a support wheel 25 for towing behind a tractor 26. The tractor 26 may be any farm tractor with a three-point hitch and power take-off at its rear end, and which has a rating of from 100–500 horsepower, more preferably, from 150–400 h.p.

The folding boom 11 is operated by an hydraulic system which includes a main hydraulic cylinder assembly 27 for pivoting the main arm 20, an extension arm hydraulic cylinder assembly 28 for pivoting the extension arm 16, and a slave hydraulic cylinder assembly 29 which responds to the lateral extension or retraction of the folding boom 11 to cause the counterweight hydraulic cylinder assembly 30 to extend or retract on the opposite side of the side-ditcher 10 so that counterweight 23 maintains the side-ditcher 10 in balance.

As the extension arm hydraulic cylinder assembly 28 is extended, the extension arm 16 is folded close to the main arm 20. As the hydraulic cylinder assembly 28 is retracted, the extension arm 16 extends, while the slave hydraulic cylinder assembly 29 also retracts, sending a proportional amount of hydraulic fluid into the counterweight hydraulic cylinder assembly 30 to cause the counterweight 23 to move outwardly from the counterweight tube 24, thereby counterbalancing the folding boom 11 to prevent tipping of the side-ditcher 10.

Figure 3:
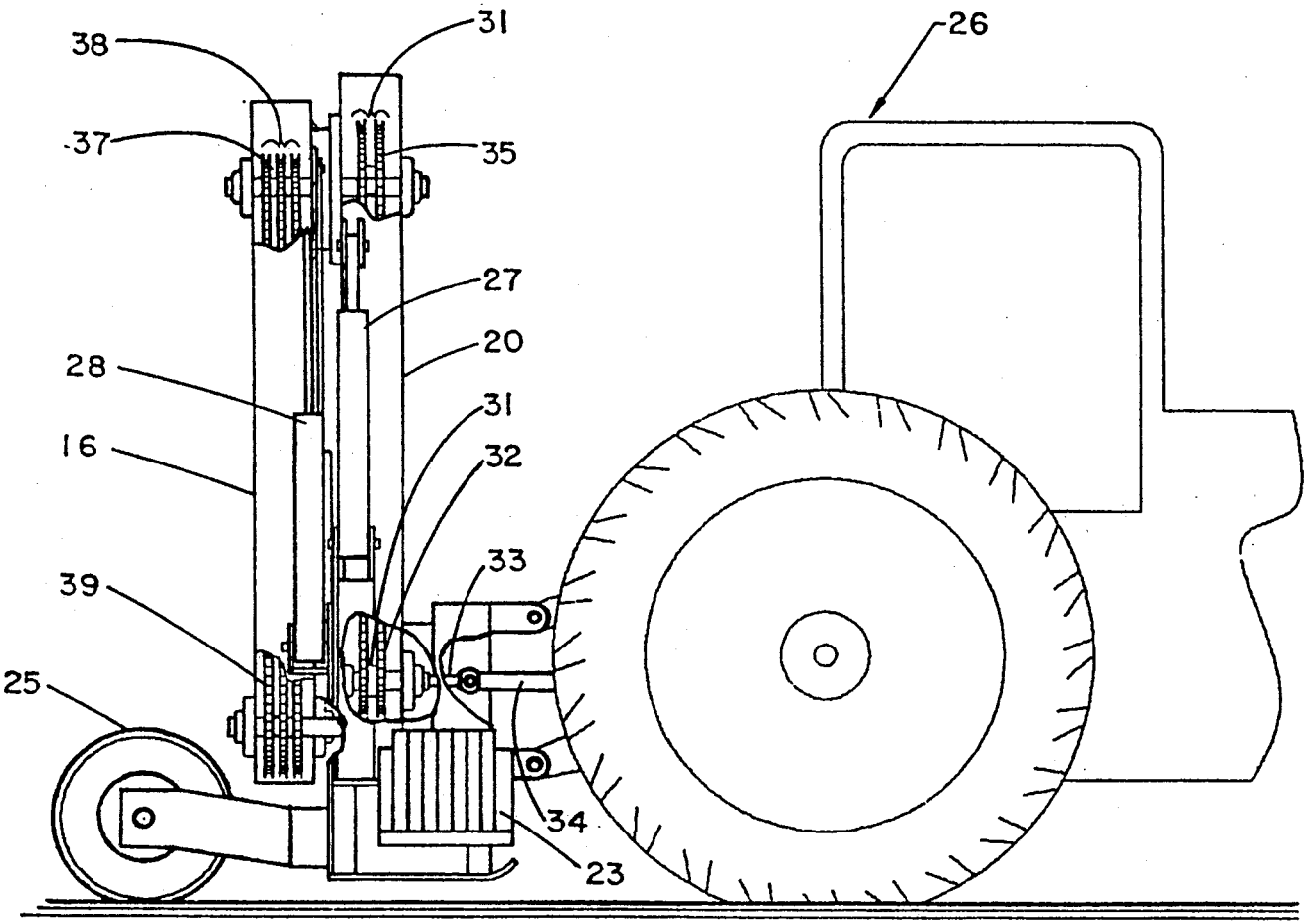
FIG. 3 is a side plan view looking from the right side of the tractor showing the side-ditcher and towing tractor, with parts broken away, to show the double chain drive, and the sprocket reduction from the power take-off (PTO) to the main arm, and from the main arm to the extension arm of the folding boom.

As best seen in FIG. 3, a double chain 31 is mounted on double drive sprocket 32 at the inner end 21 of the main arm 20. The double drive sprocket 32 is connected through sprocket drive shaft 33 to the PTO drive shaft 34 of the tractor 26. Double chain 31 extends through the main arm 20 to its outer end 19 and over a second double drive sprocket 35, which drives elbow drive shaft 36.

Elbow drive shaft 36 extends out of the outer end 19 of the main arm 20 into the inner end 17 of the extension arm 16 where it is connected to drive inner triple sprocket 37. A triple chain 38 is mounted over the inner triple sprocket 37, and extends through extension arm 16 to its outer end 15, where triple chain 38 is mounted over an outer triple sprocket 39.

Figure 2:
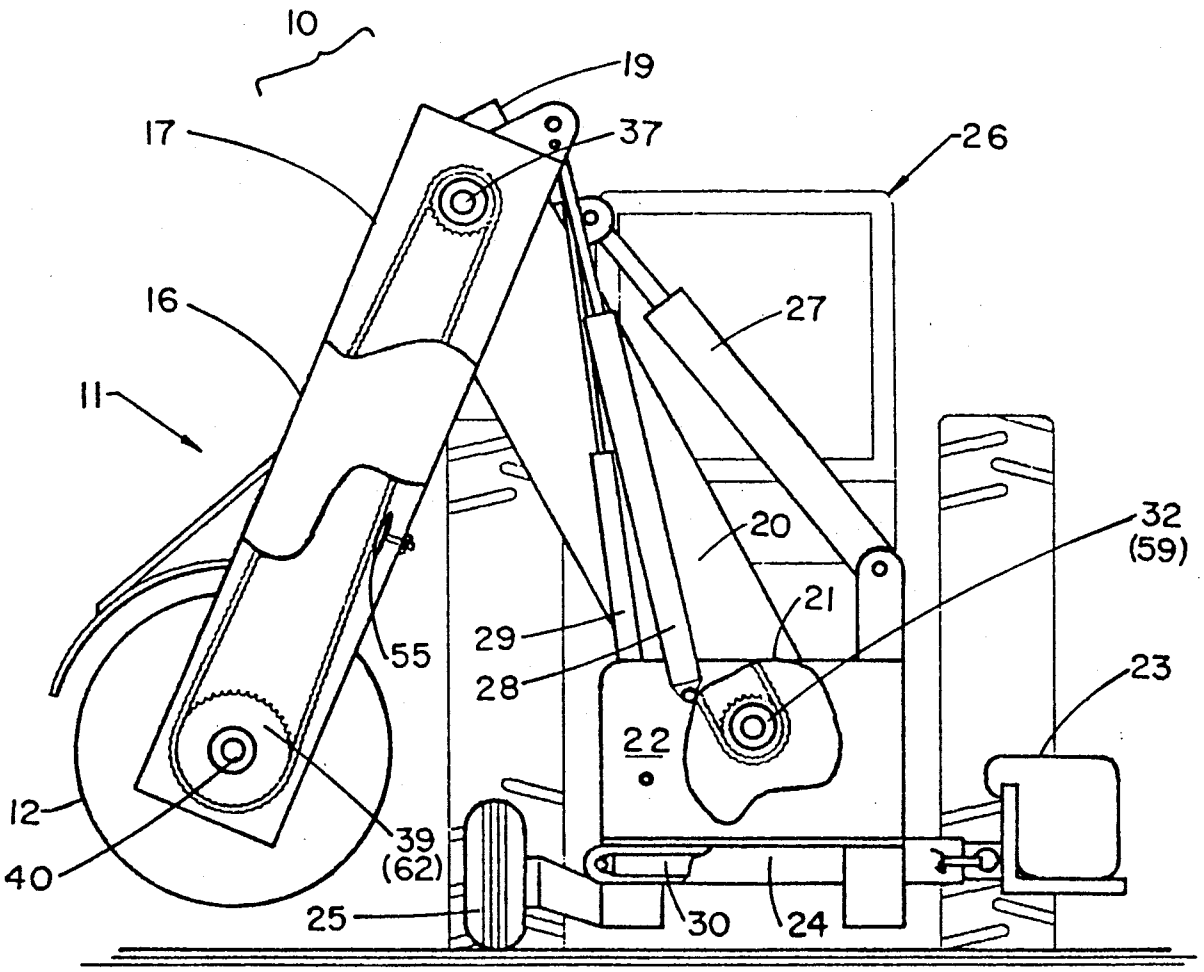
FIG. 2 is similar to FIG. 1, but with the boom in the folded position and the counterweight retracted.

As seen in FIG. 2, a power tool drive shaft 40 is connected to, and is driven by, the outer triple sprocket 39 when the triple chain 38 is driven by the inner triple sprocket 37 through the elbow drive shaft 36, which is connected to the second double drive sprocket 35. The double drive sprocket 32 drives the second double drive sprocket 35 through the double chain 31, when the sprocket drive shaft 33 is driven by the PTO drive shaft 34 from the tractor 26.

The power tool drive shaft 40 connects to the digger head 12 to rotate the digger head 12 clockwise when viewed from the rear, as shown in FIG. 1 of the drawings, to throw the dirt 14 (or other debris) outwardly away from the side-ditcher 10. Other tools (not shown) may be adapted to and attached to the power tool drive shaft 40, instead of the digger head 12. The necessary modifications to attach other tools to the drive shaft 40 will be readily apparent to those skilled in the art. For example, a mowing tool could be attached through a universal joint and suitable connecting brackets.

As best seen in FIG. 3 of the drawings, the double drive sprocket 32 has a radius which is smaller than the radius of the second double drive sprocket 35 to increase the power force output at the second double drive sprocket 35 by decreasing the r.p.m.s of its associated drive shaft 36. The inner triple sprocket 37 has a radius smaller than the radius of the second double drive sprocket 35 for further reducing the rate of travel of the triple sprocket chain, and thereby increasing the power force through sprocket 39 to the digger head 12. The total reduction in the r.p.m.s is determined by the rpms of the PTO of the tractor, which varies considerably. If the rpms at the PTO is 1500 rpm, the reduction in speed at the drive shaft 40 will vary from 250–350 rpm with a proportionate increase in power force to the digger head.

The additional power to the digger head 12 is a substantial advantage over the folding boom side-ditchers of the prior art known to us. The prior side-ditchers are all hydraulically driven, and they do not provide the extra power needed for difficult digging jobs. In fact, the typical hydraulically driven digger head has about a one third power loss, or only about 66% of the power of the PTO of the associated tractor.

This invention provides an important improvement to folding boom side-ditchers through its unique chain (or belt) drive system, which greatly increases the power output at the digger head 12. The increased power results from each reduction in the rpm obtained by the increased diameter of the drive sprockets. Increase of power to the digger head in a completely hydraulic system is complicated, and would not be economically feasible.

An important feature of the folding boom 11 is the flexible elbow 18 and its rotatable connection between the extension arm 16 and the main arm 20. The extension arm 16 has a concentric cylindrical member 41 surrounding the elbow drive shaft 36. The cylindrical member 41 is welded to the side of the inner end 17 of the extension arm 16, and there is an integral flange 42 around the outer periphery of the cylindrical member 41. The flange 42 is rotatably connected to the main arm 20 by a cap ring retainer 43 which is held in place by a plurality of nut and bolt assemblies 44 which are spaced around the periphery of the cap ring retainer 43. As the extension arm hydraulic cylinder assembly 28 is extended, the extension arm 16 is folded close to the main arm 20.

The outer ends 45 and 46 of the elbow drive shaft 36 in elbow 18 are rotatably supported by elbow drive shaft bearing 47 and 48. Seals 49 are provided on the elbow drive shaft 36 where it extends through the walls 50 and 51 of the main arm 20, and extension arm 16, respectively. Lubricating oil 52 partially fills chambers 16*a* and 20*a* of the arms 16 and 20, respectively, and is splashed up on the moving chains during operation. Zerck fittings (not shown) are used to provide lubricating grease to the retainer ring 43 and flanges 42*a* between the cylindrical member 41 and the walls 50 and 51, respectively.

Chain idlers 54 and 55 are provided for double chain 31 and triple chain 38, respectively, to keep the respective chains 31 and 38 tight during operation. The triple chain 38 is employed in the extension arm 16 because of the increase in power transmitted to the digger head 12 by the substantial increase in the diameter of the outer triple sprocket 39, as compared to the inner triple sprocket 37.

Figure 4:
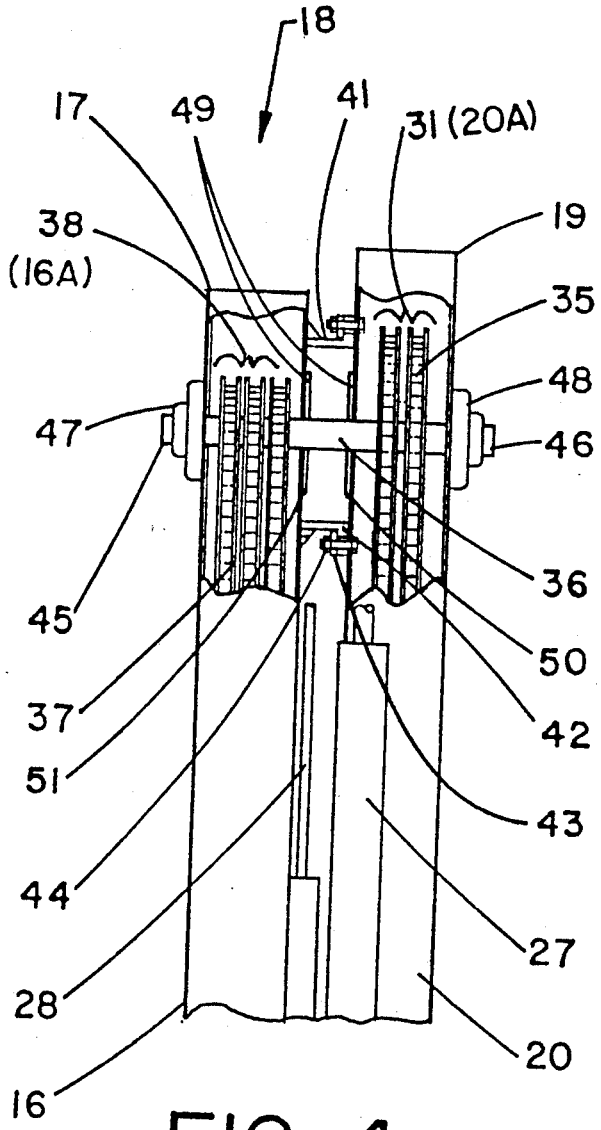
FIG. 4 is a greatly enlarged detail from FIG. 3 with parts broken away showing the chain drive connection at the elbow of the folding boom.
Figure 5:
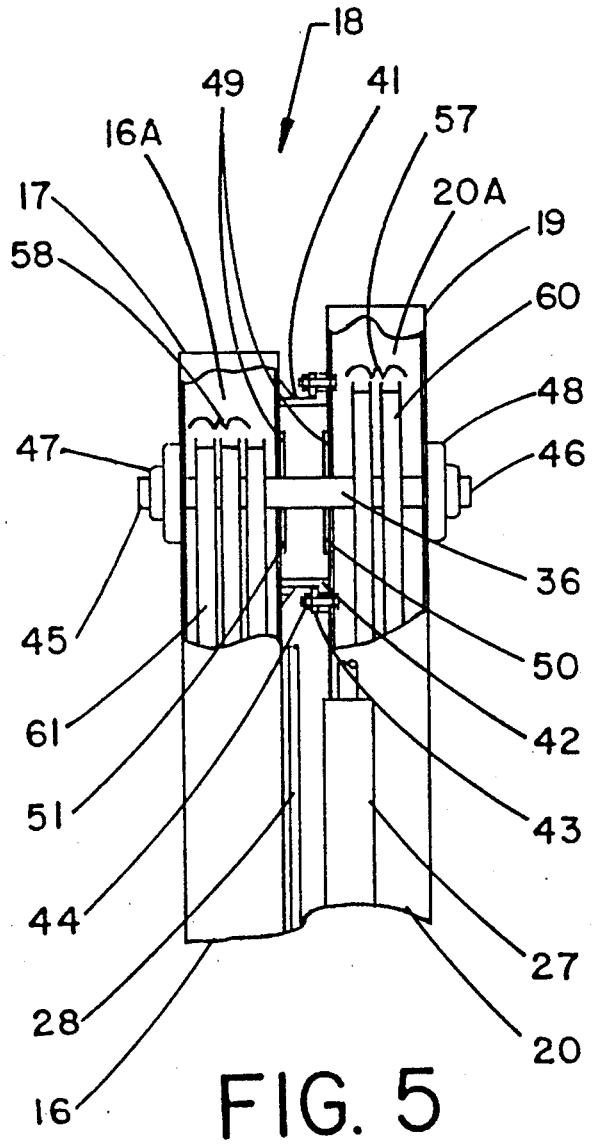
FIG. 5 is similar to FIG. 4, but showing details of a belt drive instead of a chain drive.

Belt drive assembly 56 shown in FIG. 5 is very similar to the chain drive system shown in FIG. 4. The only significant differences are double belts 57, triple belts 58, double belt drive sprocket 59, second double belt drive sprocket 60, inner triple belt drive sprocket 61, and outer triple belt drive sprocket 62.

The presently preferred double and triple drive belts are available from Gates Tire & Rubber Company, Denver, Colo., and from T. B. Woods' Sons Company, Chambersburg, Pa. The double chains 31, and triple chains 38 are available from Browning Manufacturing, Emerson Power Transmission Corporation, 1935 Browning Drive, Maysville, Ky. 41056. The length of the chains can be adjusted to exactly fit the chain drive system for the folding boom side-ditcher 10.

This improved folding boom side-ditcher is useful on farms, ranches, highway systems, or wherever surface drainage is needed. The much higher power available at the digging tool makes it possible to throw dirt or debris out away from the ditch, thereby making the cutting or cleaning more effective.

The digging apparatus may be operated from the PTO of a farm tractor. The folding boom, which is driven by the tractor's hydraulic system, allows very flexible positioning of the digger head, both horizontally and vertically. In addition, the folding boom is easily transported on a highway in a folded position behind a farm tractor, being supported by the three-point hitch. The sprocket rpm reduction from the PTO to the digger head provides extra digging power, and the digger head may be interchanged with other desired tools, such as a mower, by making very simple modifications. The hydraulic system for the folding boom need not be disconnected when tool changes are made because the tool has a completely separate, mechanical drive system supplied from the PTO of the tractor.

What is claimed is:

1. A folding boom side ditcher adapted to be driven by the power take off and the hydraulic drive system of a farm tractor, and to be attached to a three-point hitch on the back of the tractor, comprising:

a support frame adapted to be attached to a tractor;

a hydraulically operated, counterweighted, folding boom pivotally mounted on said support frame, said boom comprising a main arm pivotally connected at its inner end to the support frame, an extension arm pivotally connected at its inner end to the outer end of the main arm and at its outer end to the digger head, and a pivoting elbow connecting the main arm and the extension arm, said pivoting elbow including an outer double drive sprocket and a double drive chain in the main arm side of the elbow, a triple drive sprocket and a triple drive chain in the extension arm side of the elbow, the double drive sprocket in the elbow having a larger diameter than the diameter of the triple drive sprocket in the elbow to decrease the rpms and increase the driving force transmitted to the digger head.

2. The side ditcher of claim 1, including an inner double drive sprocket disposed in the inner end of the main arm of the folding boom, said inner double drive sprocket having a drive shaft directly connected to the power take off of the tractor, said inner double drive sprocket being a smaller diameter than the outer double drive sprocket in the main arm side of the elbow to further decrease the rpms and increase the driving force transmitted to the digger head.

3. A folding boom side ditcher having a digger head adapted to be driven by the power take off and the hydraulic system of a farm tractor which also has a hydraulic drive system to manipulate the folding boom, said side ditcher adapted to be attached to a three-point hitch on the back of the tractor, comprising:

a support frame adapted to be attached to a tractor;

a hydraulically operated, counterweighted, folding boom pivotally mounted on said support frame, said boom comprising a main arm pivotally connected at its inner end to the support frame, an extension arm pivotally connected at its inner end to the outer end of the main arm and at its outer end to the digger head; and a pivoting elbow connecting the main arm and the extension arm, said pivoting elbow including a first outer double belt drive sprocket and a corresponding first double drive belt in the main arm side of the elbow, a second triple belt drive sprocket and a corresponding second triple drive belt in the extension arm side of the elbow, the first double belt drive sprocket in the elbow having a larger diameter than the diameter of the second triple belt drive sprocket in the elbow to decrease the rpms and increase the driving force transmitted to the digger head.

4. The side ditcher of claim 3, including an inner double belt drive sprocket disposed in the inner end of the main arm of the folding boom, said inner double belt drive sprocket having a drive shaft directly connected to the power take off of the tractor, said inner double belt drive sprocket being a smaller diameter than the outer first double belt drive sprocket in the main arm side of the elbow to further decrease the rpms and increase the driving force transmitted to the digger head.

* * * * *